US008727668B2

(12) United States Patent
Dolly et al.

(10) Patent No.: US 8,727,668 B2
(45) Date of Patent: May 20, 2014

(54) DRILL TIP FOR FOUNDATION PILE

(76) Inventors: Donald Alan Dolly, Oakdale, CA (US); John Darell Honaker, Pinole, CA (US); Kenneth Robert Beveridge, Ripon, CA (US)

( * ) Notice: Subject to any disclaimer, the term of this patent is extended or adjusted under 35 U.S.C. 154(b) by 1 day.

(21) Appl. No.: 13/364,204

(22) Filed: Feb. 1, 2012

(65) Prior Publication Data

US 2012/0195691 A1 Aug. 2, 2012

Related U.S. Application Data

(60) Provisional application No. 61/574,412, filed on Aug. 1, 2011, provisional application No. 61/438,593, filed on Feb. 1, 2011.

(51) Int. Cl.
*E02D 7/14* (2006.01)

(52) U.S. Cl.
USPC ..... 405/253; 405/252.1

(58) Field of Classification Search
USPC ..... 405/231, 232, 242, 252.1, 253, 254
See application file for complete search history.

(56) References Cited

U.S. PATENT DOCUMENTS

| | | | | |
|---|---|---|---|---|
| 1,960,888 | A * | 5/1934 | Atwell | 405/253 |
| 4,458,765 | A * | 7/1984 | Feklin et al. | 175/19 |
| 4,623,025 | A * | 11/1986 | Verstraeten | 405/253 |
| 5,722,498 | A * | 3/1998 | Van Impe et al. | 405/232 |
| 6,817,810 | B2 * | 11/2004 | Jones | 405/253 |
| 6,824,331 | B2 * | 11/2004 | Parker | 405/252.1 |
| 7,267,510 | B2 * | 9/2007 | Dimitrijevic | 405/252.1 |

* cited by examiner

*Primary Examiner* — Frederick L Lagman
(74) *Attorney, Agent, or Firm* — Brian Beverly; Beeson Skinner Beverly, LLP

(57) ABSTRACT

An improved drill tip 10 for a foundation pile 28 includes a pile attachment structure 12 and a soil penetrating body 14 depending from the attachment structure, the soil penetrating body having a plurality of circular stepped flights 38 forming the shape of a descending continuous conic spiral and having a continuous spiral-shaped lower face 44 and an undercut outer face 46, the soil penetrating body including a lower end 48 having an inverted generally conical center structure 51 surrounded by a plurality of symmetrically distributed downwardly extending soil disturbing blades 52.

10 Claims, 9 Drawing Sheets

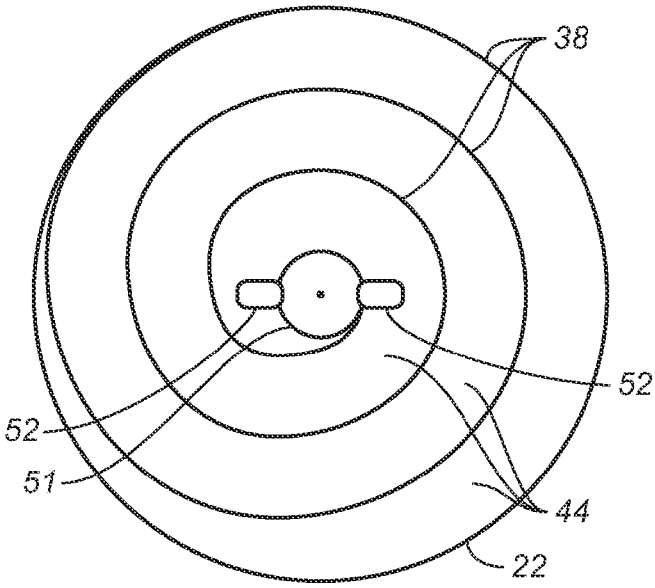
FIG. 5
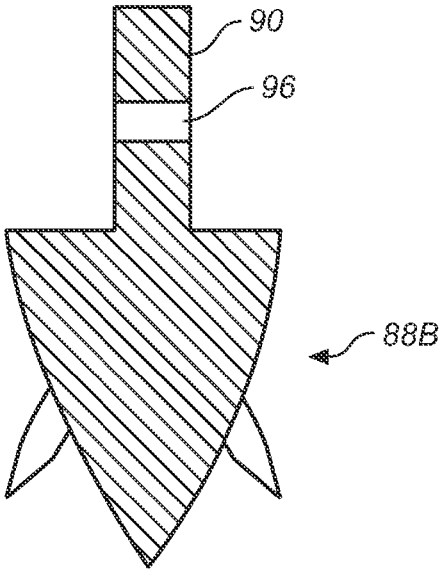
FIG. 9A
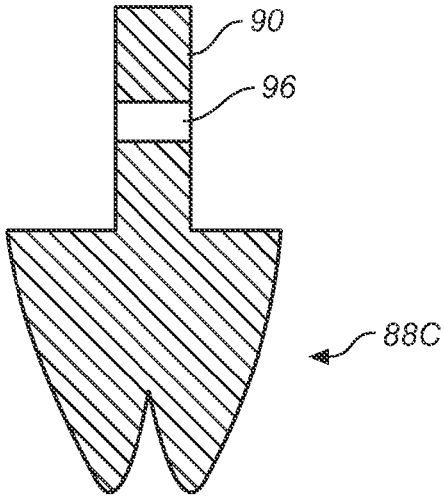
FIG. 9B
FIG. 12
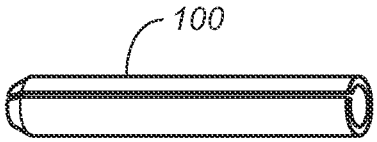

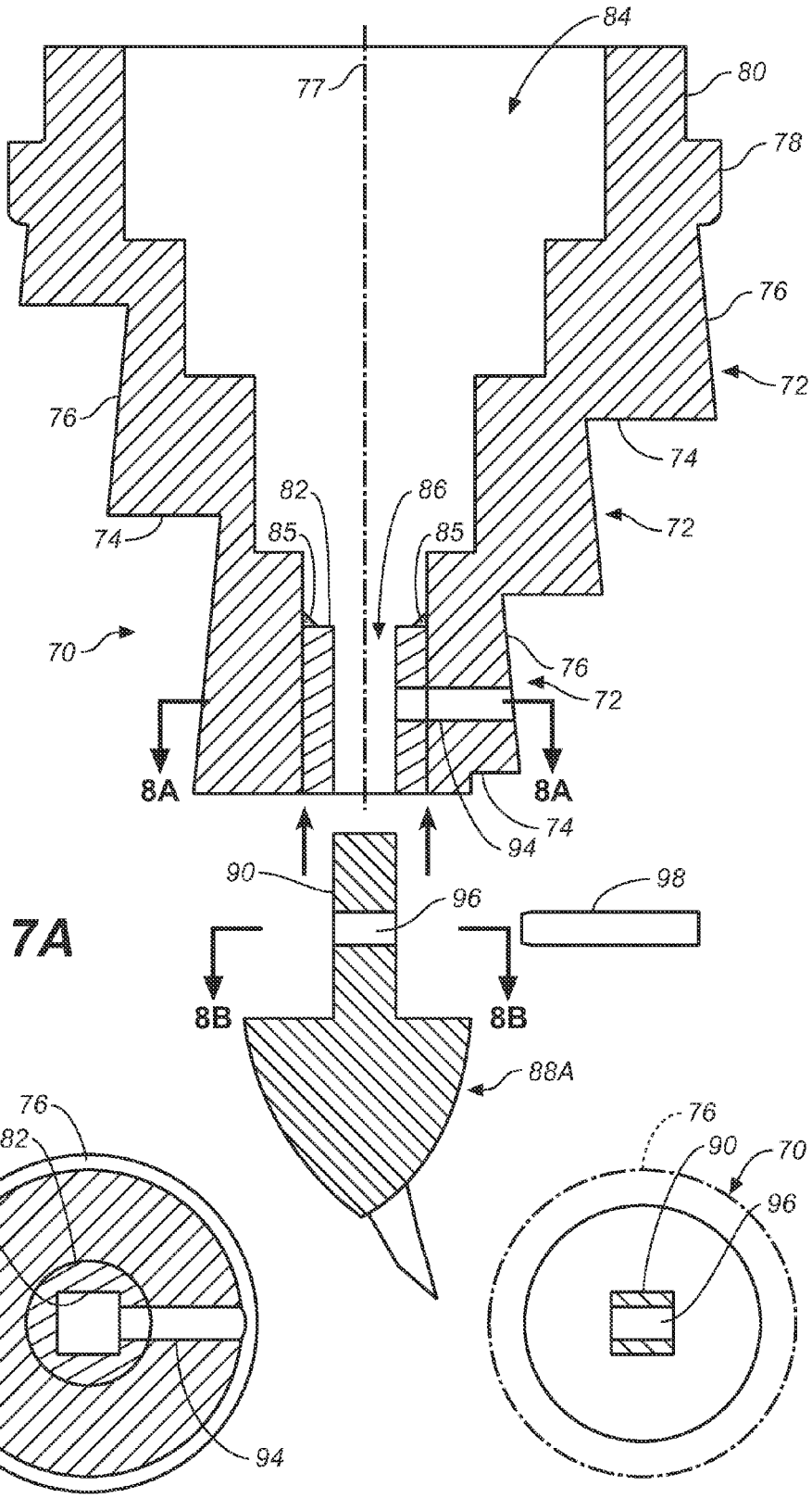
FIG. 7A
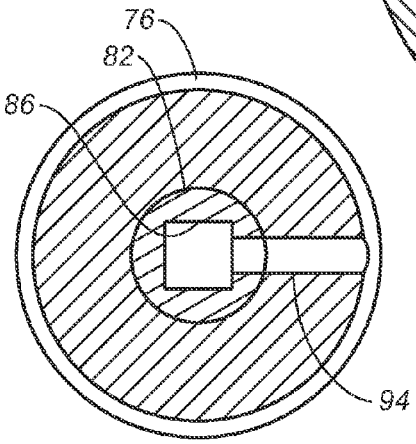
FIG. 8A
FIG. 8B

DRILL TIP FOR FOUNDATION PILE

CROSS-REFERENCE TO RELATED APPLICATIONS

This application claims the benefit of Provisional Application No. 61/438,593 filed Feb. 1, 2011, and of Provisional Application No. 61/284,412 filed Aug. 1, 2011.

FIELD OF THE INVENTION

This invention is directed to rotary foundation pile drilling technology and in particular to a drill tip for screw-type foundation piles that has an improved ability to penetrate the soil.

BACKGROUND

Deep foundations are widely used as foundation elements for structures. Two well known classes of piles are non-displacement piles and displacement piles. The former are installed by excavating a cylinder of soil from the ground and replacing it with is some form of reinforcement, commonly, concrete. By far the most common method of excavating the soil is by use of an auger, giving rise to the term auger cast-in-place (ACIP) piles.

Displacement piles are either driven or drilled into the ground. Displacement piles laterally displace soil surrounding the pile shaft and load soil materials below the toe of the pile. Displacement piles are generally understood to have a stiffer response than non-displacement piles, and are capable of carrying larger loads than non-displacement piles. However, driving piles into the ground can result in excessive vibration and noise and are, therefore, problematic under certain conditions.

Drilled displacement piles are rotary displacement piles installed by inserting a cylindrical soil displacement body into the ground with the combined application of torque and vertical force, the latter commonly referred to as "crowd." The soil displacement body may include single or multiple helices that help penetrate and laterally displace the soil. An auger tip is attached to the bottom end of the cylindrical body. Drilled displacement piles have favorable end bearing and skin friction capacities compared to ACIP piles. However, to install drilled displacement piles expensive specialty equipment is required that produces tremendous torque and crowd forces to drive the pile into the soil. An installation process that is less efficient correspondingly increases the expense of the foundation. There is, therefore, a need for improved drilled displacement piles to reduce the power requirements and expense associated with their installation.

SUMMARY OF THE INVENTION

An improved drill tip according to the invention comprises a cylindrical pile is attachment structure for attaching the drill tip to a pile and a soil penetrating body depending from the bottom side of the attachment structure. The pile attachment structure has a diameter no greater than the width of the pile.

The soil penetrating body comprises a plurality of circular stepped flights forming the shape of a descending continuous conic spiral organized around a center axis. The flights extend outwardly no further than the diameter of the pile attachment structure so that the bore created by insertion of the pile in the ground using the new drill tip is defined by the diameter of the attachment structure. The flights comprise a continuous spiral-shaped lower face which intersects with an undercut continuously spiraling outer face.

The lower end of the soil penetrating body terminates in a generally conical center structure around and below which are provided a plurality of firmly attached symmetrically distributed downwardly extending soil disturbing blades which create an entry point in the soil for the plurality of stepped flights.

BRIEF DESCRIPTION OF THE DRAWINGS

FIG. 5 is a bottom plan view of the drill tip of FIG. 1.

FIG. 7A is an exploded sectional elevational view of an alternate embodiment of a drill tip according to the invention.

FIG. 8A is a sectional view of the lowermost portion of the circular flights of the drill tip taken along lines 8A-8A of FIG. 7A.

FIG. 8B is a sectional view of the pilot shown in FIG. 7A taken along lines 8B-8B of FIG. 7A.

FIG. 9A is a sectional elevational view of an alternate pilot.

FIG. 9B is a sectional elevational view of a second alternate pilot.

FIG. 12 is a side perspective view of a roll pin.

DESCRIPTION OF THE ILLUSTRATED EMBODIMENT

Figure 2A:
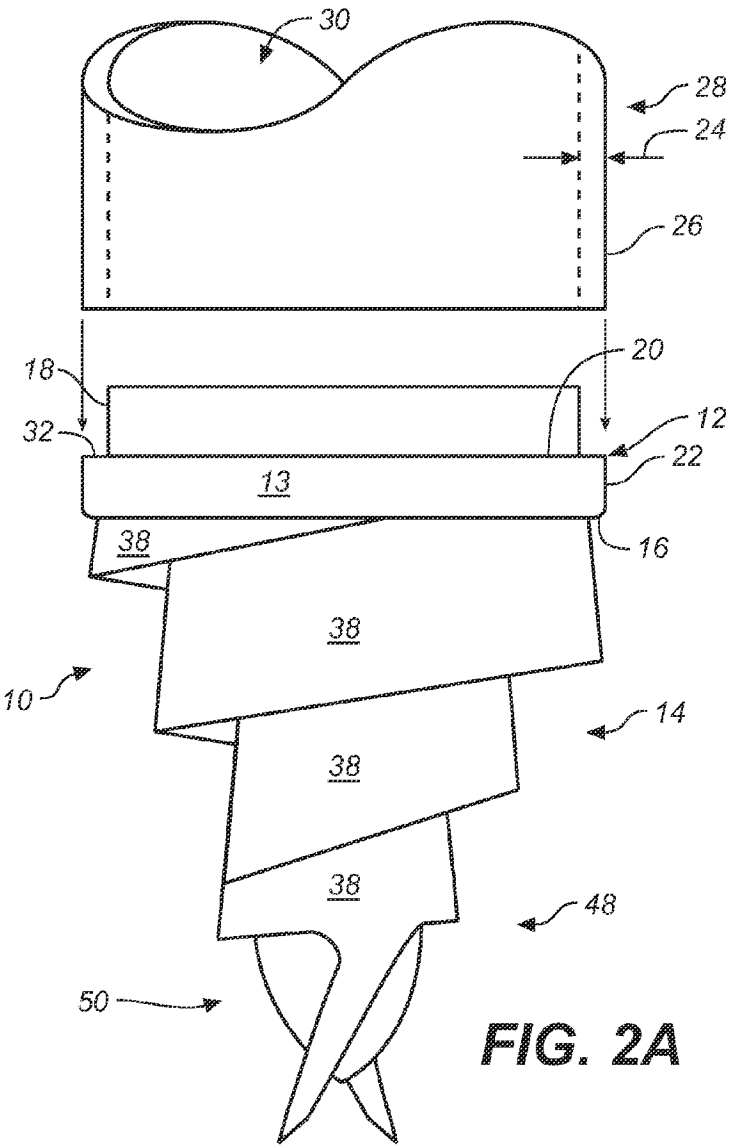
FIG. 2A is a side elevational view of the drill tip of FIG. 1 shown positioned below the bottom end of a pile.
Figure 1:
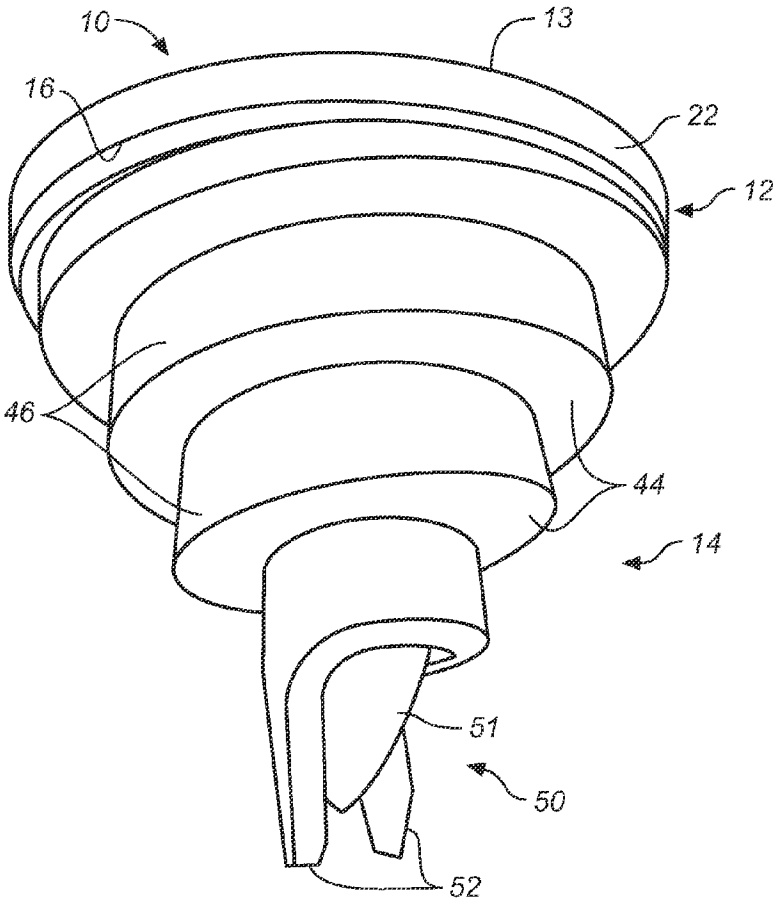
FIG. 1 is a lower perspective view of an improved drill tip according to the invention.
Figure 3:
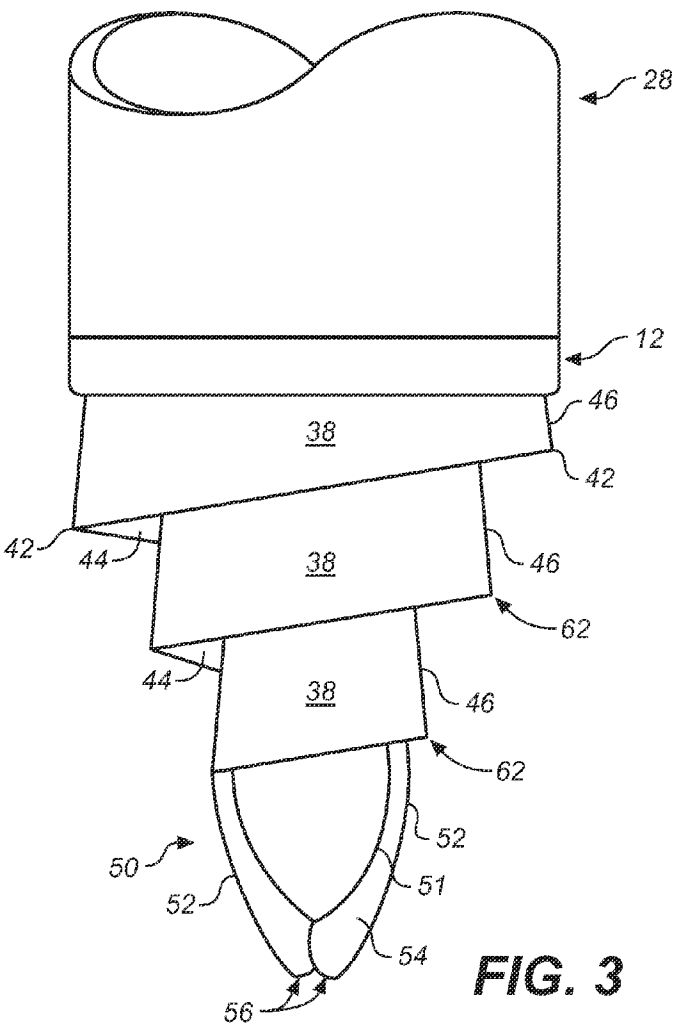
FIG. 3 is another side elevational view of the drill tip of FIG. 1 shown from a view is point at 90 from the viewpoint of FIG. 2A.
Figure 2B:
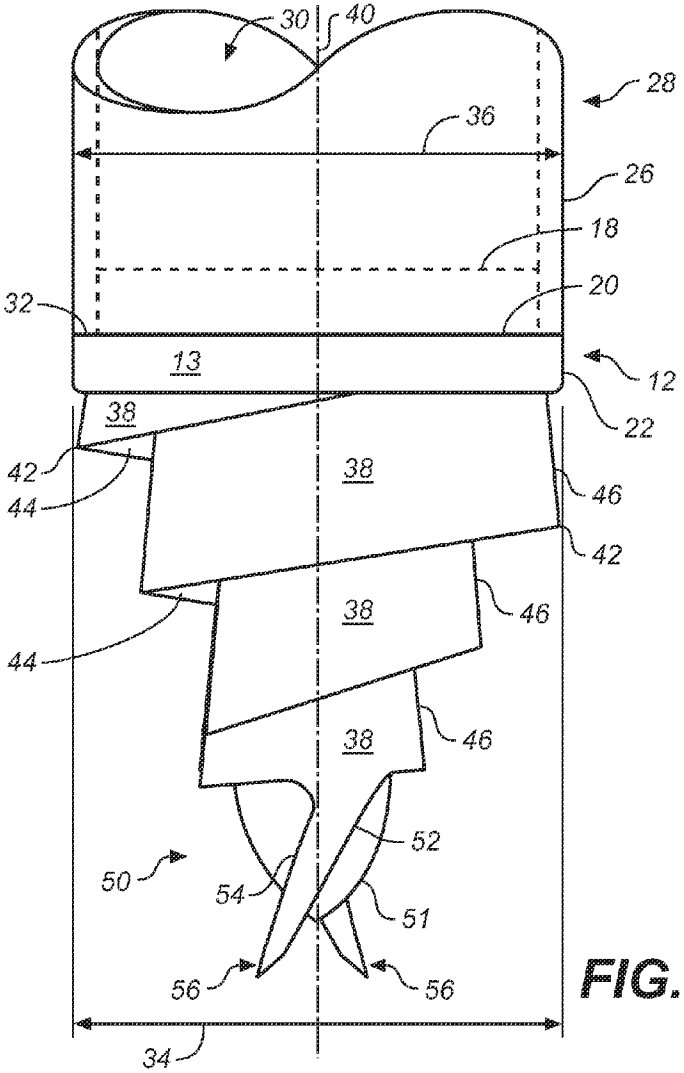
FIG. 2B is a side elevational view of the drill tip similar to that shown in FIG. 2A shown attached to the bottom end of the pile.

An improved drill tip 10 according to the invention, indicated generally in FIG. 1, comprises a pile attachment structure 12 and a soil penetrating body 14 integrally formed with and depending from the bottom side 16 of the pile attachment structure 12 as shown in FIG. 2A. The pile attachment structure 12 has a circular flange 13 and a cylindrical lip 18 extending upwardly from the top side 20 of the flange 13. The lip 18 is inset from the outer edge 22 of the flange 13 by an amount approximately equivalent to the thickness 24 of the cylindrical side wall 26 of pipe pile 28. The lip 18 is thus sized such that it may be inserted into the hollow interior 30 of the pile 28, as defined by side wall 26, for positioning the pile attachment structure 12 in concentric alignment with the pile 28. Lip 18 defines a cylindrical seating surface 32 around the periphery of the top side 20 of the flange 13 for securely seating the side wall 26 of the pile thereon as shown in FIG. 2B. In usual practice, the pile attachment structure 12 will be firmly attached to the pile 28 by welding, but the invention is intended to embrace means for attachment other than welding, such as mechanical joints, and is also intended to include mechanisms for detachable attachment of the drill tip 10 to the pile 28. In the illustrated embodiment, the pile attachment structure 12 has an attachment structure is diameter 34 that is no greater than the pile diameter 36. Since the attachment structure diameter 34 is at least as large as the width of any component of the soil penetrating body 14 discussed below, the bore formed by drilling into the soil with the drill tip 10 has a diameter no greater than the attachment structure diameter 34 or the pile diameter 36.

Referring now to FIGS. 2B and 3-5, the soil penetrating body 14 includes a plurality of stepped circular flights 38 formed in the shape of a descending continuous conic spiral organized around a center axis 40. The outer extent 42 of each flight 38 does not extend radially outward from the center axis 40 beyond the attachment structure diameter 34. The plurality of flights 38 together comprise a continuous spiral-shaped lower face 44, best seen in FIG. 5, having a horizontal profile in a vertical plane coincident with center axis 40. The stepped flights also collectively form a continuous spiraling outer face 46 which intersects with lower face 44. With respect to FIG. 4, it can been seen that the outer face 46 forms an acute angle A generally between four and six degrees, and usually approximately five degrees, relative to center axis 40 such that outer face 46 is somewhat undercut relative to lower face 44. While in the illustrated embodiment, the soil penetrating body 14 is formed of approximately three flights 38, those of skill in the art will understand that the drill tip 10 may be formed according to the invention with some variation in the number of flights 38. For example, a drill tip could be formed with only two flights or with four or more flights depending on soil conditions and availability of equipment. Furthermore, the flights 38 in the embodiment illustrated in FIGS. 1-6 have a pitch of approximately 2¾" on a 16" diameter pile. It will be appreciated that the pitch of the flights in alternative embodiments of the invention is may vary. Finally, the angle of the cone forming the gross geometry of alternate embodiments may vary from that shown in the illustrated embodiment according to field conditions and equipment availability.

Figure 4:
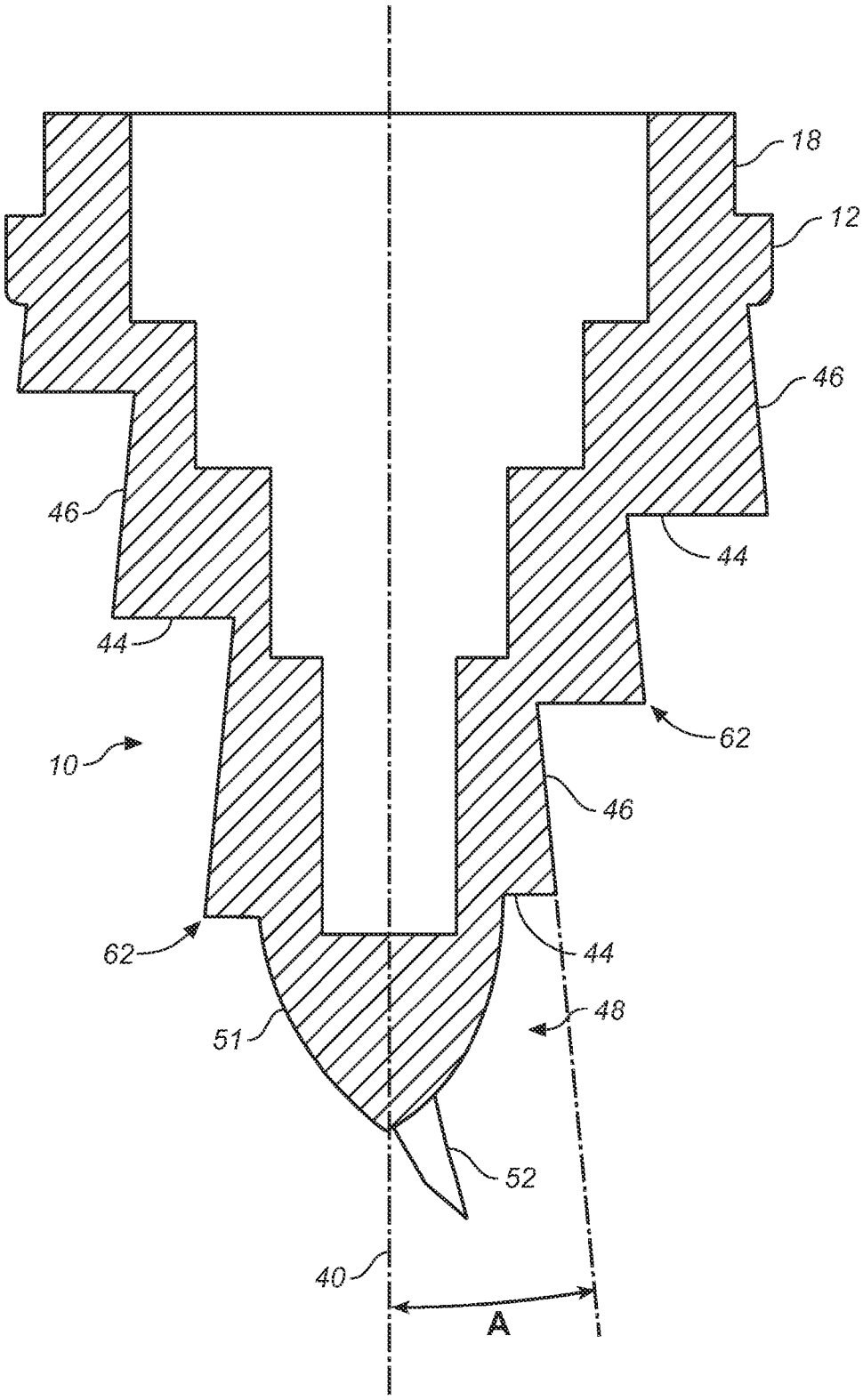
FIG. 4 is a sectional view of the drill tip shown in FIG. 2A taken along lines 4-4.

The lower end 48 of the soil penetrating body 14 terminates in pilot tip 50. In the embodiment shown in FIGS. 1-6, the pilot tip is an inverted generally conical center structure 51 surrounded by a plurality of firmly attached symmetrically distributed downwardly extending soil disturbing blades 52. In the illustrated embodiment, the conical center structure 51 is shaped like an inverted pointed dome, but it should be understood that some variation in the shape of the center structure 51 is to be expected in alternate embodiments. Each blade 52 has a forward face 54 forming a steep downward angle in a vertical plane coincident with said center axis of approximately twenty degrees as shown in FIGS. 2A, 2B and 4. The lowermost portions 56 of blades 52 extend below the conical structure 50 in a symmetrical configuration resembling a swiveling fish tail. In the illustrated embodiment, there are two soil disturbing blades 52, but it will be understood by those of skill in the art that in other embodiments there could be three, four or more blades.

Figure 6:
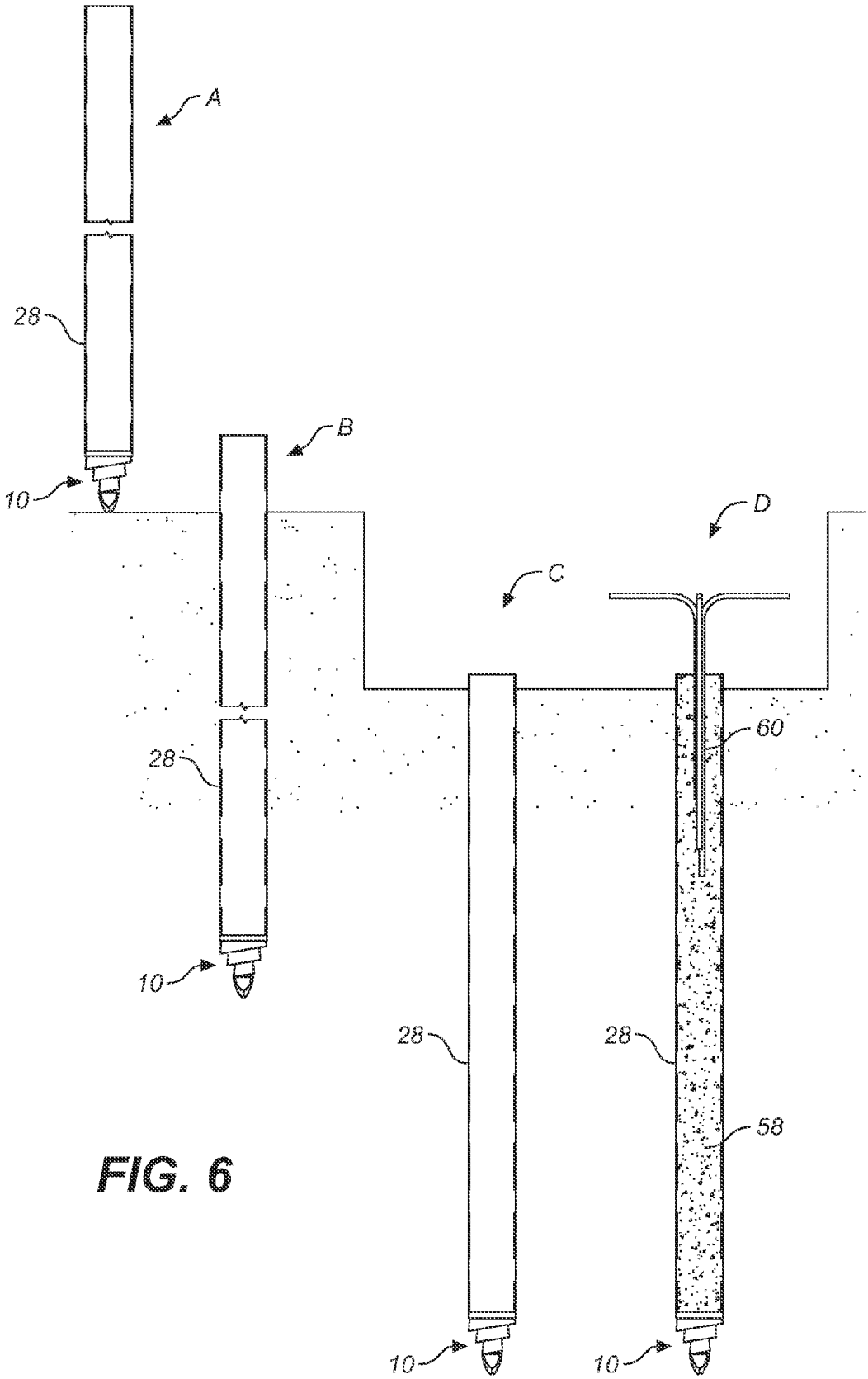
FIG. 6 is an illustration showing several stages of installation in the ground of a pile using the drill tip of FIG. 1.

Referring now to FIG. 6, in normal operation in the field, after the drill tip 10 is attached to a hollow foundation pile 28, the combination is gripped in a pile drilling rig or drill table and placed on the ground surface as shown at A. Torque is then applied to the pile 28 together with downward force that causes the tip 10 and pile 28 to penetrate the ground as shown at B. The combination of torque and downward pressure causes lower face 44 to act as an outwardly spiraling cutting surface which establishes a is cylindrical bore to receive a foundation pile. The amount of torque required to turn the tip into the ground is reduced because the undercut angle of the outer faces 46 relative to the lower face 44 reduces engagement of the outer faces 46 with the surrounding soil as the tip cuts into the ground thereby reducing skin friction of the outer faces 46 with the soil. In extensive testing, applicants have determined that the combination of features in the pile tip described above results in an improved ability to penetrate the soil. The improved soil penetration capacity of drill tip 10 decreases the amount of torque required to turn the pile into the soil and reduces the time needed to install the pile. The improved drill tip also has a better end bearing capacity than existing drilled displacement piles because, as can be best appreciated with reference to FIG. 5, the lower faces 44 of the flights 38 in combination provide a more structurally sound base as compared to the flighting and helices of other pile tips.

After the pile 28 reaches the desired depth, it is cut off at the proper pile elevation according to the foundation design and reinforcement, as shown at C, concrete 58 is inserted into the pile and construction rebar 60 set in the concrete, as shown at D. Alternatively, the pile may be left hollow and a mechanical connection added to the outside of the pile to connect the pile 28 to a pile cap (not shown).

Piles typically have diameters of 12, 14, 16, 18, 20, 22, 24, 30 or 36 inches. Although the drill tip described above can be constructed according to any of these pile diameters, it is expected that the improved drill tip will most commonly be used with piles have diameters of 12.75" and 16.00". It will also be understood that the configuration of the drill tip may be modified as required to accommodate different soil is profiles.

An alternate embodiment 70 of the invention is illustrated in FIGS. 7A-8B. The alternate embodiment 70 is similar to the first embodiment shown in FIGS. 1-6 comprising a plurality of circular stepped flights 72 having a continuous spiral-shaped lower face 74 and a continuous outer face 76 organized around a center axis 77. The flights 72 are integrally formed with and depend from an annular pile attachment structure 78 having an upstanding cylindrical lip 80 configured for attachment to a pile as discussed above in connection with the first embodiment. A core 82 is firmly secured in the interior space 84 between the lowermost of the flights 72 as shown in FIG. 7A. Although the core 82 is joined to the flights 72 by welds 85 as illustrated in FIG. 7A, it is anticipated that the core may be attached using a variety of other means such as by using threaded fasteners or adhesives. One of skill in the art would also recognize that welds could be applied between the core 82 and the flights 72 at the lower ends thereof. It will also be appreciated by those of skill in the art that, rather than affixing a core 82 as shown in FIG. 7A, the circular flights 72 can be formed so that the core is integrally formed with the plurality of circular flights 72. A downwardly facing vertically extended socket 86 having a square cross sectional profile is provided in the center of the core 82 as shown in FIGS. 7A and 8A.

With additional reference to FIGS. 8A, 8B, 9A and 9B, each of a plurality of different pilot tips 88A-88C is provided with a square shaped insert 90 sized for mating engagement with socket 86. Each of the pilot tips 88A-88C is designed for use with different soil conditions. Thus, the alternate embodiment of the invention provides a "mix-and-match" capability allowing selection of one of the plurality of different pilot tips 88A-88C, according to what is deemed most appropriate for on-site soil conditions, which together with the flights 72 form a soil penetrating body 92. While the illustrated embodiment shows a square shaped socket 86 and square shaped insert 90, those of skill in the art will appreciate that the profiles of the socket 86 and the insert 90 may assume other polygonal shapes shows such as a triangle, pentagon or hexagon.

Figure 7B:
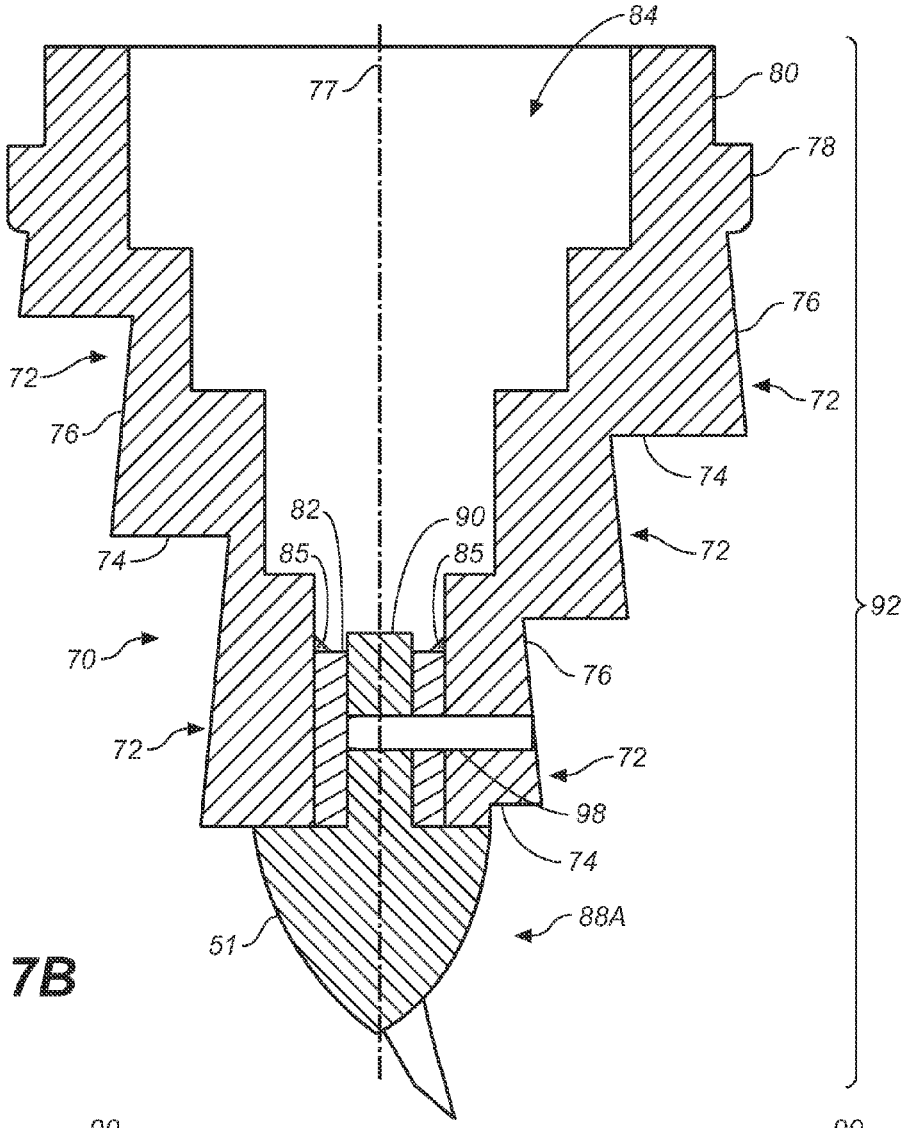
FIG. 7B is a sectional elevational view of the alternative embodiment of the drill tip shown in FIG. 7A showing the parts assembled.
Figure 7C:
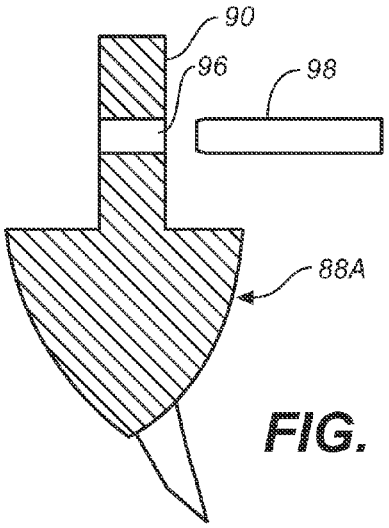
FIG. 7C is a sectional elevational view of a pilot and fastening pin.
Figure 7D:
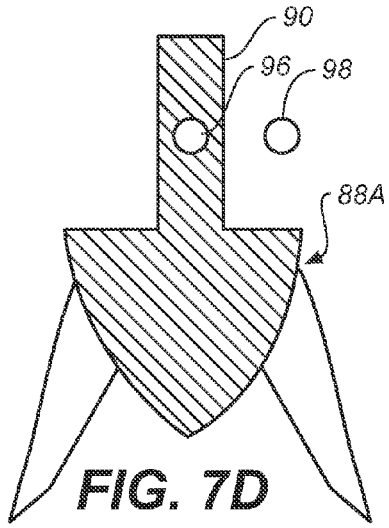
FIG. 7D is a sectional elevational view of the pilot and fastening pin view from a 90 angle relative to FIG. 7C.
Figure 11A:
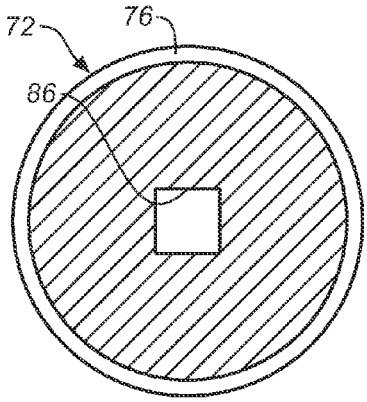
FIG. 11A is a sectional view of the lowermost portion of the circular flights of the drill tip taken along lines 11A-11A of FIG. 10A.
Figure 11B:
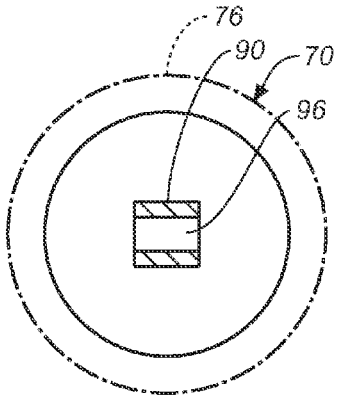
FIG. 11B is a sectional view of the pilot shown in FIG. 10A taken along lines 11B-11B of FIG. 10A.

In a further aspect of the invention, a receiving bore 94 extending from outer face 76 to socket 86 is provided in the lowermost of the plurality of circular flights 72 as shown in FIG. 7A. A cylindrical aperture 96 in the insert 90 of each pilot tip 88A-88C has a diameter sized to correspond to the diameter of receiving bore 94. When the insert 90 of a selected one of pilot tips 88A-88C is positioned inside socket 86 with receiving bore 94 and cylindrical aperture 96 in linear alignment, a fastening pin 98, such as a steel dowel, is inserted into the aligned receiving bore 94 and aperture 96 thereby holding insert 90 in socket 86 and retaining the selected pilot tip, such as pilot tip 88A shown in FIG. 7B, engaged with the plurality of circular flights 72. It will be appreciated by those of skill in the art that once the soil penetrating body is introduced into the ground the downward force employed when installing the drill tip will press the pilot tip 88A-88C upwards against the circular flights 70 thereby obviating any further need for the fastening pin 98. Thus, the fastening pin need only be strong enough to retain the selected pilot tip 88A-88C on the plurality of circular flights 72 during above-ground pre-installation activities. The fastening pin 98 may be manufactured of a ductile steel material but it is not intended to so limit the invention. Rather it is intended that the invention should encompass fastening pins of any suitable material of reasonably inexpensive manufacture that can readily be inserted into the aligned receiving bore 94 and aperture 96 to secure a selected pilot tip to the circular flights, including various polymers, woods and other metals. In one aspect of the invention, the fastening pin may be slightly tapered on its inward end to facilitate its insertion especially in situations where there may be casting irregularities or other defects in the circular flights 72, core 82, insert 90, socket 86, aperture 96 or other parts. Finally, while the illustrated embodiment is shown and described as the receiving bore 94, insert aperture 96 and fastening pin 98 all having a circular profile, it is anticipated that these related parts may have different shaped profiles such as square, triangular or rectangular.

In another aspect of the invention, the fastening pin 98 may be provided in the form of a roll pin 100 as seen in FIG. 12. A roll pin has the capacity to marginally collapse when being introduced into a bore or aperture having a diameter slightly smaller than the roll pin. Accordingly, when a roll pin 100 that is slightly larger in diameter than receiving bore 94 is forcibly introduced therein, it will collapse sufficiently to enter the receiving bore 94 while accommodating any imperfections or nonlinear services in the interior surfaces of the bore 94 or aperture 96.

Figure 10A:
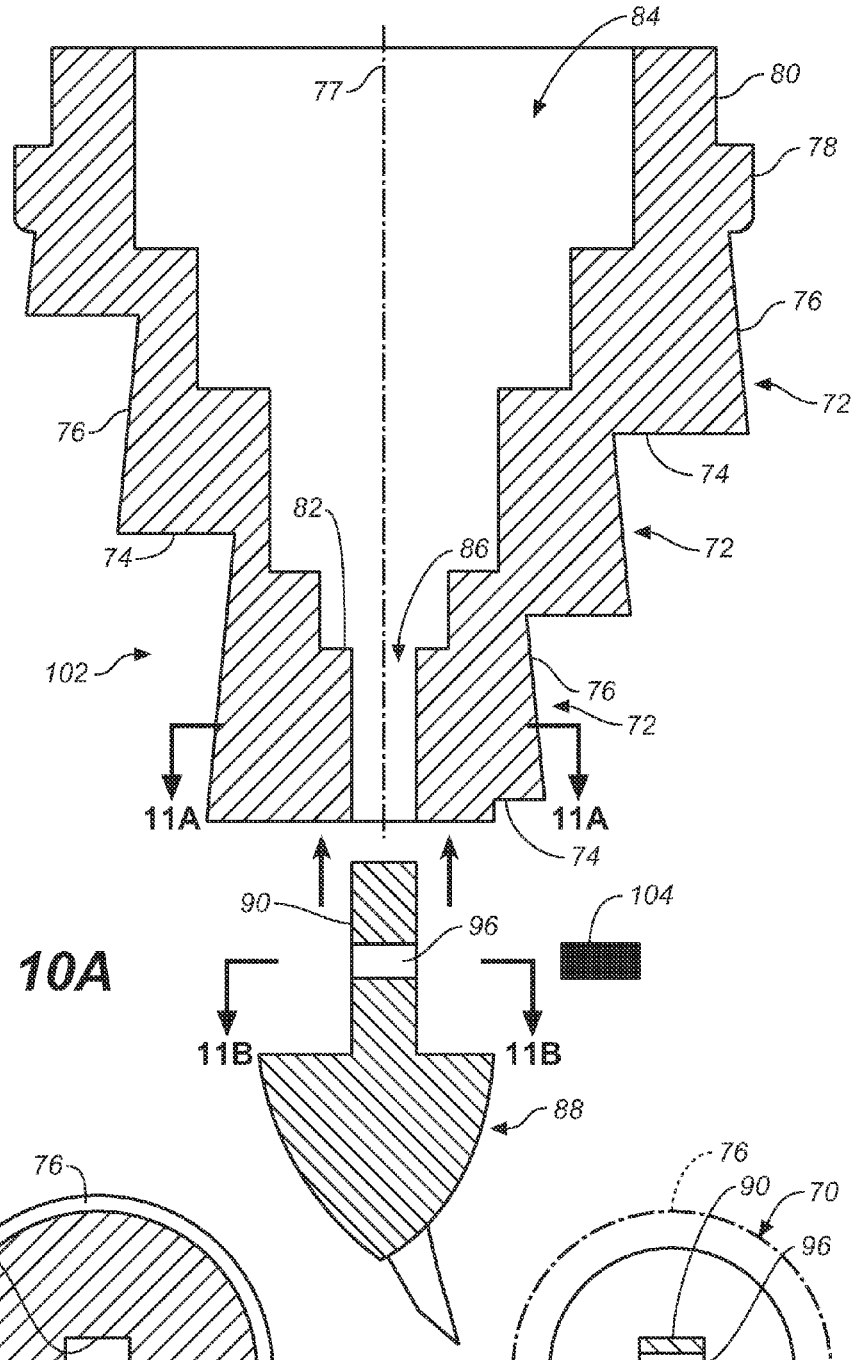
FIG. 10A is an exploded sectional elevational view of a second alternate embodiment of a drill tip according to the invention.
Figure 10B:
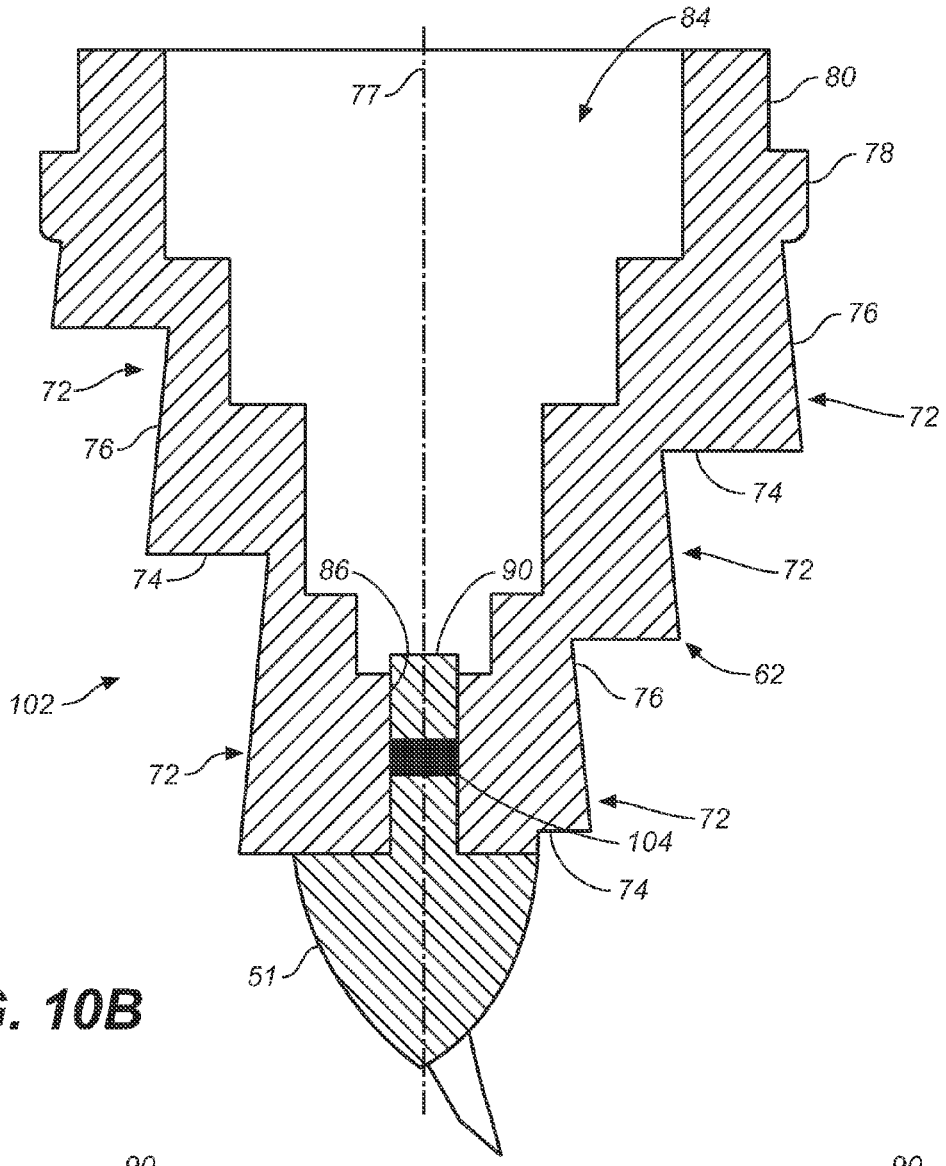
FIG. 10B is a sectional elevational view of the alternative embodiment of the drill is tip shown in FIG. 10A showing the parts assembled.
Figure 10C:
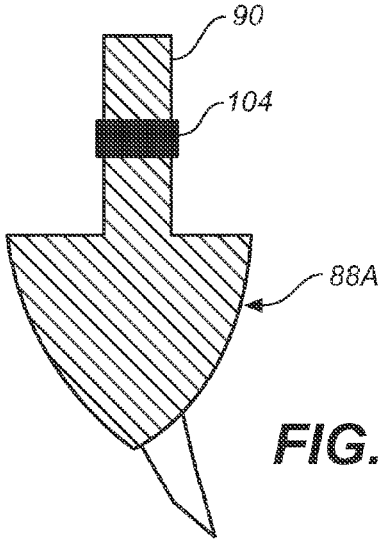
FIG. 10C is a sectional elevational view of an alternate embodiment of the pilot tip and fastening pin of the embodiment shown in FIGS. 10A-10B.
Figure 10D:
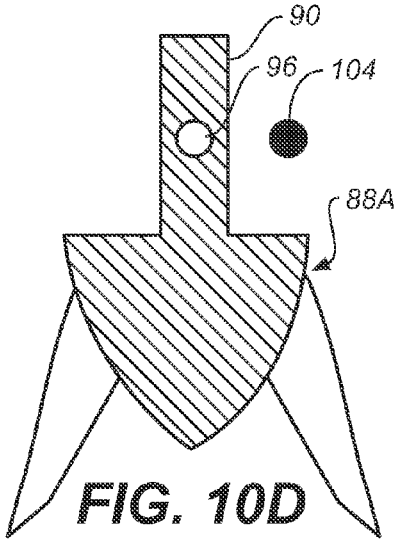
FIG. 10D is a sectional elevational view of the pilot tip and fastening pin of the embodiment shown in FIGS. 10A-10B viewed from a 90 angle relative to the view shown in FIG. 10C.

A second alternate embodiment 102 of the invention, shown in FIGS. 10A-10D and 11A-11B, is similar to the embodiment shown in FIGS. 7A-8B, except that core 82 is integrally formed with the lowermost portion of the plurality of circular flights and receiving bore 94 has been eliminated. In place of fastening pin 98, a shorter friction pin 104 is provided having a length slightly greater than the length of the aperture 96 in the insert 90 in pilot tip 88A. See FIGS. 10C and 10D. As shown in FIG. 10C, when inserted and centered in aperture 96, friction pin 104 extends slightly outward of the aperture 96 on each side. When insert 90 is pressed fitted into socket 86 as seen in FIG. 10B a frictional interference fit is created which retains the insert 90 in the socket 86.

There have thus been described and illustrated certain preferred embodiments of an improved drill tip for a foundation pile. Although the present invention has been described and illustrated in detail, it is clearly understood that the same is by way of illustration and example only and is not to be taken by way of limitation, the spirit and scope of the present invention being limited only by the terms of the appended claims and their legal equivalents.

We claim:

1. A drill tip for a foundation pile comprising:

a soil penetrating body including a plurality of circular stepped flights and a lower end, said plurality of circular stepped flights formed generally in the shape of a descending continuous conic spiral, said plurality of flights having a continuous spiral-shaped lower face and a continuous outer face intersecting said lower face, said lower end having a pilot tip having a generally conical center structure surrounded by a plurality of downwardly extending soil disturbing blades, said blades having lowermost portions extending below said conical center structure in a configuration resembling a swiveling fish tail.

2. The drill tip of claim 1 wherein:

said soil disturbing blades are symmetrically disposed about and attached to said generally conical center structure at the lower end of said soil penetrating body.

3. The drill tip of claim 2 further comprising:

a center axis, wherein said soil disturbing blades each have a forward face forming an angle in a vertical plane coincident with said center axis of approximately twenty degrees.

4. A drill tip for a foundation pile comprising:

a soil penetrating body including a plurality of circular stepped flights and one or more pilot tips, said plurality of circular stepped flights formed generally in the shape of a descending continuous conic spiral, said plurality of flights having a continuous spiral-shaped lower face, a continuous outer face intersecting said lower face, and a lower end, said lower end including a downwardly facing vertically extending socket having a polygonal horizontal profile, and each of said one or more pilot tips including an insert having a profile corresponding to the profile of said socket, said insert sized for mating engagement with said socket such that when the insert of a selected one of said one or more pilot tips is positioned in said socket said pilot tip extends downwardly from the lower end of said soil penetrating body.

5. The drill tip of claim 4 wherein:

the profile of said socket is square shaped.

6. The drill tip of claim 4 further comprising:

the lower end of said circular flights having a receiving bore extending from the outer face of said circular flights to said socket, said bore having a diameter, the insert of each of said one or more pilot tips having an aperture having a diameter corresponding to the diameter of said bore, and a fastening pin sized for insertion into said receiving bore and said aperture, such that when the insert of a selected one of said one or more pilot tips is positioned in said socket with the aperture of the insert of said pilot tip in linear alignment with said receiving bore, insertion of said fastening pin in said receiving bore and said aperture holds said pilot tip onto said circular flights.

7. The drill tip of claim 6 wherein:

said fastening pin comprises a roll pin.

8. The drill tip of claim 4 wherein:

said socket has walls defining a width, the insert of each of said one or more pilot tips having an aperture having a diameter, and a friction pin sized for insertion into said aperture and being longer than the diameter of said aperture and slightly longer than the width of said socket, such that when said friction pin is positioned in said aperture and said insert is press fitted into said socket a friction fit between said friction pin and the walls of said socket results that is sufficient to retain said insert in said socket.

9. A drill tip for a foundation pile, the pile having a pile diameter, the drill tip comprising:

a pile attachment structure having a bottom side and an attachment structure diameter no greater than the pile diameter, a center axis, and a soil penetrating body including a plurality of circular stepped flights and a lower end, said plurality of circular stepped flights depending from said bottom side, organized around said center axis, formed generally in the shape of a descending continuous conic spiral extending radially a distance no greater than said attachment structure diameter, and having a continuous spiral-shaped lower face and a continuous outer face intersecting said lower face, said outer face forming an acute angle in a vertical plane coincident with said center axis such that said outer face is undercut relative to said lower face, said lower face forming a horizontal profile in a vertical plane coincident with said center axis, said lower end having a generally conical center structure surrounded by a plurality of downwardly extending soil disturbing blades, said blades having lowermost portions extending below said conical center structure in a form resembling a swiveling fish tail.

10. A drill tip for a foundation pile, the pile having a pile diameter and a cylindrical side wall bounding a hollow interior, said side wall having a side wall thickness, the drill tip comprising:

a pile attachment structure having a bottom side, a top side, an outer edge, a periphery and an attachment structure diameter no greater than the pile diameter, said top side having an upstanding cylindrical lip inset from said outer edge by an amount approximately equivalent to the side wall thickness of the pile, said lip defining a cylindrical seating surface around said periphery for seating the side wall of the pile on said attachment ring, a center axis, and a soil penetrating body having a plurality of circular stepped flights and a lower end, said plurality of circular stepped flights having the general form of a descending continuous conic spiral organized around said center axis, said plurality of circular stepped flights depending from said bottom side, extending radially a distance no greater than said attachment ring diameter, and having a continuous spiral-shaped lower face and a continuous outer face intersecting said lower face, said outer face forming an acute angle in a vertical plane coincident with said center axis such that said outer face is undercut relative to said lower face, said lower face forming a horizontal profile in a vertical plane coincident with said center axis, and said lower end having a generally conical center structure surrounded by a plurality of downwardly extending soil disturbing blades, said blades having lowermost portions extending below said conical center structure in a form resembling a swiveling fish tail.

* * * * *